US009396886B2

(12) United States Patent
Reinhart et al.

(10) Patent No.: US 9,396,886 B2
(45) Date of Patent: Jul. 19, 2016

(54) ACTUATING DEVICE

(75) Inventors: Markus Reinhart, Hassmersheim (DE); Gerd Hofmann, Eberbach (DE)

(73) Assignee: COOPER CROUSE-HINDS GMBH, Soest (DE)

( * ) Notice: Subject to any disclaimer, the term of this patent is extended or adjusted under 35 U.S.C. 154(b) by 173 days.

(21) Appl. No.: 14/123,749

(22) PCT Filed: Jun. 1, 2012

(86) PCT No.: PCT/EP2012/002338

§ 371 (c)(1),
(2), (4) Date: May 27, 2014

(87) PCT Pub. No.: WO2012/163543

PCT Pub. Date: Dec. 6, 2012

(65) Prior Publication Data

US 2014/0326585 A1 Nov. 6, 2014

(30) Foreign Application Priority Data

Jun. 3, 2011 (DE) ..... 10 2011 103 492

(51) Int. Cl.
*H01H 19/14* (2006.01)
*H01H 3/20* (2006.01)
(Continued)

(52) U.S. Cl.
CPC . *H01H 3/20* (2013.01); *H01H 3/40* (2013.01); *H01H 3/46* (2013.01); *H01H 3/54* (2013.01);
(Continued)

(58) Field of Classification Search
CPC . H01H 71/56; H01H 2071/565; H01H 9/286; H01H 3/40; H01H 9/281; H01H 9/283
USPC ..... 200/43.11, 43.14, 336, 43.19
See application file for complete search history.

(56) References Cited

U.S. PATENT DOCUMENTS 2,870,288 A 1/1959 Schmidt
5,219,070 A * 6/1993 Grunert ..... H01H 9/281 200/330

(Continued)

FOREIGN PATENT DOCUMENTS

DE 3519368 A1 12/1986
DE 4300313 C1 3/1994

(Continued)

OTHER PUBLICATIONS

Johann Modl, DE Application No. 102011103492.0 German Examination Report, Mar. 16, 2012, 10 pages, Deutsches Patent- und Markenamt.

(Continued)

*Primary Examiner* — Renee S Luebke
*Assistant Examiner* — Ahmed Saeed
(74) *Attorney, Agent, or Firm* — King & Spalding LLP

(57) ABSTRACT

An actuating device is proposed for an electric/electronic device within an in particular flame-proof housing. The electrical/electronic device includes an essentially linearly movable on/off lever. In order to provide such an actuating device being accessible on the exterior of the respective flameproof housing and allowing mechanical actuation of the respective on/off lever without adversely affecting the flameproof housing, the actuating device includes at least a rotatably mounted handle disposed on the outside of the housing and a shaft connected with it in a rotatably fixed manner, the shaft being guided into the housing interior and there being connected movably to the on/off lever by a transformation gear for transforming rotational motion into linear motion.

16 Claims, 3 Drawing Sheets

(51) Int. Cl.

| | |
|---|---|
| ***H01H 9/04*** | (2006.01) |
| ***H01H 71/56*** | (2006.01) |
| ***H01H 3/40*** | (2006.01) |
| ***H01H 3/46*** | (2006.01) |
| ***H01H 3/54*** | (2006.01) |
| ***H01H 9/28*** | (2006.01) |
| ***H01H 19/08*** | (2006.01) |

(52) U.S. Cl.

CPC ..... *H01H 9/04* (2013.01); *H01H 9/286* (2013.01); *H01H 19/08* (2013.01); *H01H 19/14* (2013.01); *H01H 71/56* (2013.01); *H01H 2071/565* (2013.01); *H01H 2221/01* (2013.01); *H01H 2221/024* (2013.01); *H01H 2221/03* (2013.01)

(56) References Cited

U.S. PATENT DOCUMENTS 5,302,925 A * 4/1994 Castonguay ..... H01H 71/501 200/43.14

2010/0033907 A1 * 2/2010 Baird ..... H01H 9/04 361/624

FOREIGN PATENT DOCUMENTS

| | | | |
|---|---|---|---|
| DE | 19714834 | A1 | 10/1998 |
| DE | 102009053164 | A1 | 5/2011 |
| EP | 0522848 | A2 | 1/1993 |
| FR | 2622734 | | 5/1989 |
| JP | 05190073 | | 7/1993 |
| JP | 2011014431 | | 1/2011 |

OTHER PUBLICATIONS

Jose Miguel Nieto, PCT/EP2012/002338 International Search Report, Aug. 29, 2012, 2 pages, European Patent Office.

The Patent Examination Bureau I of Korean Intellectual Property Office, Translation of the Korean Intellectual Property Office Notice of Office Action issued on Oct. 27, 2014 in Application No. 10-2013-7033593, 8 pages.

Japanese Patent Office, Japanese Office Action issued on Nov. 26, 2014 in Application No. 2014-513084, 3 pages, translation 5 pages.

* cited by examiner

ACTUATING DEVICE

RELATED APPLICATIONS

This application is a Section 371 national phase application of and claims priority to PCT application PCT/EP2012/002338 filed on Jun. 1, 2012, which claims priority to German Patent Application Number 10 2011 103 492.0 filed on Jun. 3, 2011, the contents of which are incorporated herein in their entirety.

BACKGROUND

Potentially explosive areas have a plurality of electrical and electronic devices disposed there. They often comprise switching devices in the interior of a flameproof housing. Such a switching device is for example an essentially linearly movable on/off lever. Such electrical and electronic equipment can comprise cut-off switches, power switches, circuit breakers or the like.

SUMMARY

The present invention has the object to provide a respective actuating device for such electrical/electronic devices which is accessible at the exterior on the respective flame-proof housing and allows mechanical actuation of the respective on/off lever without adversely affecting the flameproof housing.

The objective is satisfied by the features of claim 1.

According to the invention, the actuating device comprises at least a rotatably mounted handle disposed at the outside of the housing and a shaft connected therewith in a rotatably fixed manner. The shaft is guided into the housing interior and is there connected movably to the on/off lever by means of a transformation gear for transforming rotational motion into linear motion.

In other words, when turning the handle, the respective shaft rotates in an analogous manner. This rotational motion is transformed into linear motion by the transformation gear by means of which the on/off lever is switchable between its various positions. The actuating device according to the invention comprises only mechanical parts complying with respective mechanical requirements regarding explosion protection and the like. The electrical requirements regarding explosion protection are fulfilled by the flameproof housing and the electrical/electronic equipment contained therein.

Various transformation gears are conceivable that transform rotational motion into linear motion. A simple example of such a transformation gear can be seen in that it comprises at least one gear wheel rotationally connected to the shaft and a gear rod portion being in engagement with its gearing and being connected movably to the on/off lever. When rotating the shaft, the gear wheel (pinion) rotates along and the rotation is transformed into linear motion of the gear rod portion (rack) by means of the engagement with the gear rod portion, which in turn, due to of its movable connection to the on/off lever, adjusts the latter accordingly.

In this context, it is usually sufficient, if the gear wheel has at least a partial gearing. It is formed on the gear wheel, on its side facing the gear rod portion. It is also conceivable that the gear wheel with two partial gearing portions simultaneously moves two gear rod portions in opposite directions.

In order to locate the gear rod portion in a simple manner relative to the gear wheel, the gear rod portion can be arranged on a sliding member, which is connected movably to the on/off lever. This sliding member moves together with the gear rod portion in a manner corresponding to the rotation of the gear wheel. In this manner, the on/off lever does not need to be directly connected to the gear rod portion, but indirectly via the interpositioned sliding member.

The on/off lever can have different dimensions or shapes, depending on the manufacturer or also on the electrical/electronic device. In order to enable respective actuation also in this context, the sliding member can comprise in particular an exchangeable lever insert for engagement with the on/off lever. This lever insert is formed to fit to the respective lever and is used depending on the lever.

In order to enable simple engagement of the movable connection between the lever insert and the on/off lever, the lever insert can comprise a lever slot for partially receiving the on/off lever. This lever slot is then essentially adapted to the shape and the dimensions of the lever.

In order to, in addition to the gear rod portion or portions, also position the gear wheel by means of the sliding member, the sliding member can on its upper side facing the gear wheel comprise a gear wheel holding fixture. It allows a respective rotation of the gear wheel by means of the associated shaft. At the same time, the gear wheel holding fixture can provide a certain amount of support and spatial fixation to the gear wheel.

A simple embodiment of such a gear wheel holding fixture can comprise two oppositely disposed, essentially inverted L-shaped holding flanges, in-between which the gear wheel is arranged. In this manner, the gear wheel is at least rotatably supported along two sides.

In this context, it can further prove to be favorable, when the gear rod portion is supported by the holding flange in particular in a detachable manner. No additional measures for arranging and supporting the gear rod portion are then necessary. The corresponding teeth on the gear rod portion can protrude only to the extent that the corresponding teeth on the gear wheel are also still at least partially covered by the holding flange.

The upper side of the sliding member can comprise a flat sliding surface, in order to not adversely affect the gear wheel's rotation in particular due to friction, when it contacts the sliding member.

In order to be able to exchangeably arrange the lever insert in a simple manner, it can be insertable into the sliding member essentially transversely to its sliding direction into an insert holding fixture that is open in a direction towards the on/off lever.

In order to be able to both guide and also support the lever insert in the insert holding fixture, essentially rail-shaped sliding guide devices can be formed at the lever insert and at the insert holding fixture.

In order to be able to arrange the corresponding actuating device in a simple manner at the housing, the handle can be detachably mounted to a shaft end of the shaft protruding outwardly from the housing.

By means of this attachment of the handle and the shaft end, it is optionally also achievable, that the actuating device is detachably mounted at the housing. However, other attachment means for detachably mounting the actuating device can in this context be used.

An easy way for detachably mounting the handle at the corresponding shaft end is a spring ring which can be arranged between the handle and the shaft end.

In order to avoid inadvertent actuation of the lever by means of the actuating device, the handle can comprise a locking device which is releasable for initiating the rotational motion of the handle.

An example of such a locking device is a stop element at the housing and an adjustable stop counter element on the handle.

In order to be able to easily adjust the stop counter element, it can be formed as a sliding member displaceable along the handle.

Such a sliding member can, for instance, be displaceably supported at one end of the handle. Only after respective displacement of the sliding member is the stop counter element no longer in abutment with the stop element and the locking device is without effect, so that the handle is respectively rotatable.

In order to enable the handle to be automatically locked in a certain position, the sliding member can be acted upon by force in the direction of the stop element, in particular by an elastic element.

It is also possible that the sliding member must be moved into such a locking position by the operator in order to bring the stop element and the stop counter element in abutment.

BRIEF DESCRIPTION OF THE DRAWINGS

In the following, an advantageous embodiment of the invention is further illustrated using the figures appended in the drawing.

DETAILED DESCRIPTION OF EXAMPLE EMBODIMENTS

Figure 1:
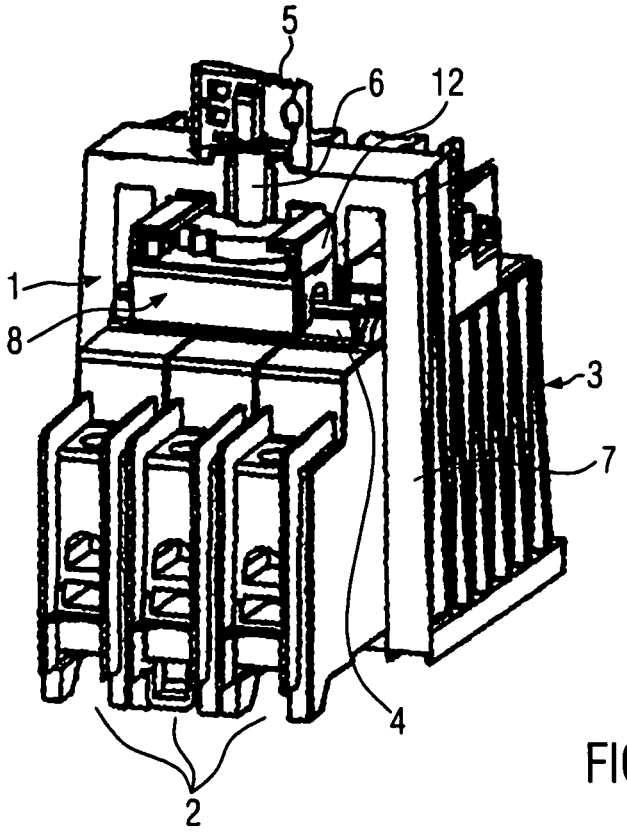
FIG. 1 shows a partially sectional perspective view of a housing with the actuating device according to the invention.

FIG. 1 shows a lateral and partial perspective view of a flame-protected housing 3 of an electrical/electronic device 2 with an embodiment of an actuating device 1 according to the invention. The electrical/electronic device is for example a cut-off switch, a power switch or a circuit breaker. An on/off lever 4 is disposed in the housing 3 and is essentially linearly movable between at least two positions. All relevant electrical/electronic devices 2 are disposed inside the housing in the interior of the housing 7 and comply with the respective requirements for explosion protection, such as Ex-i, Ex-e, Ex-d or the like.

Figure 2:
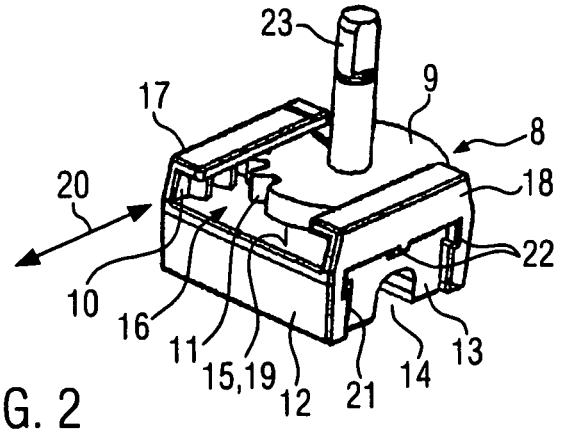
FIG. 2 shows an enlarged view of the actuating device without the handle.

A sliding member 12, being part of the actuating device 1, is disposed of the on/off lever for its mechanical actuation. The sliding member 12, see also FIG. 2, is part of a transformation gear 8, which transforms rotational motion of a handle 5 to linear motion. The respective handle 5 is arranged outside of the flameproof housing 3.

FIG. 2 shows the actuating device without a handle 5, enlarged and in detail.

The handle 5 according to FIG. 1 is detachably mounted on an upper shaft end 23 of a shaft 6. The shaft 6 at its end opposite the handle 5 comprises a gear wheel 9, which is connected to the shaft 6 in a rotatably fixed manner. The gear wheel 9, at least along part of its circumference, comprises partial gearing 11. According to FIG. 2, it is assigned to a gear rod portion 10. Respective teeth of the partial gearing 11 or the gear rod portion 10, respectively, engaged with each other, so that upon rotation of the gear wheel 9, the gear rod portion 10 is displaceable in the displacement direction 20.

The gear rod portion 10 is arranged on the sliding member 12. The sliding member 12 comprises two inverted L-shaped holding flanges 17 and 18 disposed laterally and opposite to one another. A gear rod portion 10 is disposed below one of these holding flanges 17.

The sliding member 12 on its upper side 15 comprises a sliding surface 19 between the two holding flanges 17, 18. The gear wheel 9 is arranged on it or at a small distance from it, where its partial gearing 11 engages underneath the holding flanges 17, 18 in order to engage with the gear rod portion 10.

Overall, the holding flanges 17, 18, with the sliding surface 19 disposed therebetween, form a gear wheel holding fixture 16 by means of which the gear wheel in supported both laterally as well as partially in the direction to the shaft 6.

The sliding member 12 on one underside comprises an insert holding fixture 21 open towards the on/off lever 4, see also FIG. 1. The lever insert 13 is inserted into it. For holding and for lateral guidance of the lever insert 13, there are a number of sliding guide devices 22 arranged between it and the insert holding fixture 21, which are formed essentially in the shape of rails.

On an underside being oriented towards the lever 4, the lever insert 13 comprises a lever slot 14 which extends essentially orthogonally to the displacement direction 20. The lever slot 14 is essentially adapted to the shape and dimensions of the lever 4, see also FIG. 3.

The lever insert 13 can be exchanged for a different lever insert having a particular other lever slot 14, depending on the type of on/off lever 4

Figure 3:
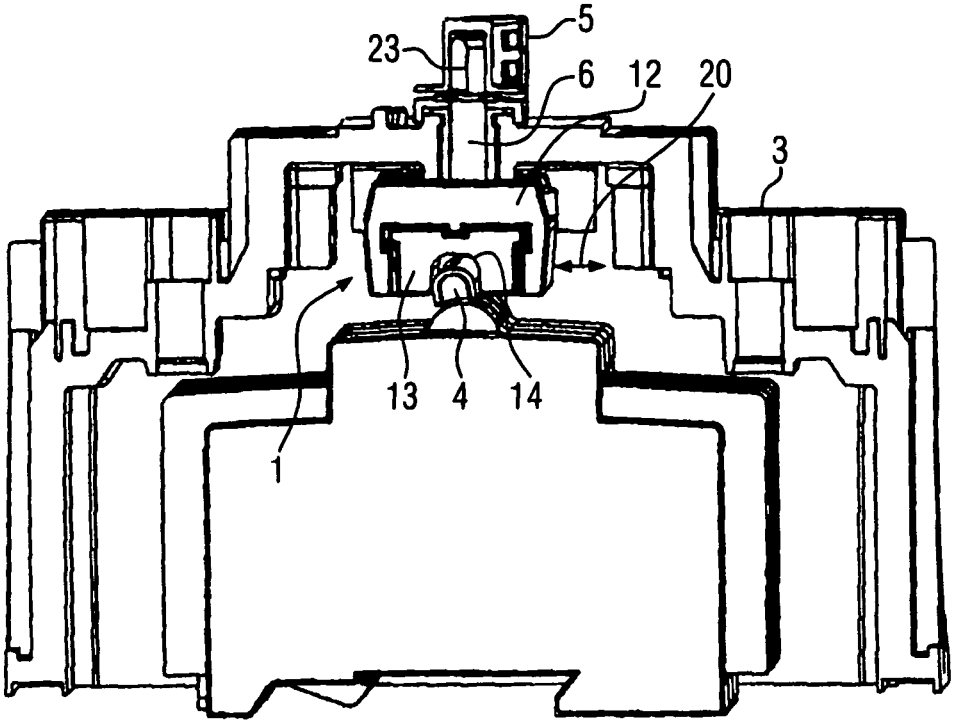
FIG. 3 shows a side view of a housing according to FIG. 1 with the actuating device.

FIG. 3 in analogy to FIG. 1 shows the respective housing 3 in a partially sectional side view. It is particularly apparent, that the on/off lever 4 at least partially engages with the lever slot 14 of the lever insert 13. By respective adjustment of the sliding member 12 in the displacement direction 20, the on/off lever 4 is moved, where, according to the embodiment of FIG. 3, it travels along a partially circular path during its adjustment. The lever slot 14 is associated with the on/off lever 4 such that its sufficient engagement with the lever slot 14 is always given, also during this pivoting motion of the lever.

Overall, the actuating device 1 according to the invention allows mechanical actuation of the lever, without there being any electrical or electronic connections led out of the flameproof housing 3. All these devices are arranged within the housing 3.

Figure 4:
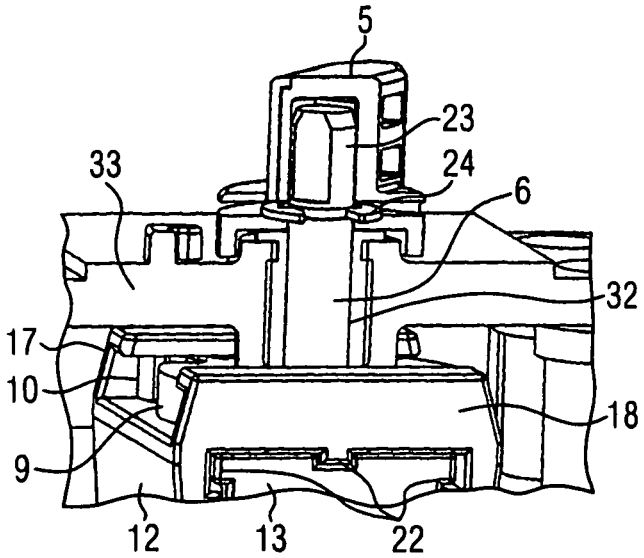
FIG. 4 shows an enlarged view of part of the actuating device according to the invention.

The shaft 6 is for its support rotatably mounted in a bushing 32 led through a housing wall 33, see also FIG. 4. The dimensions of the shaft 6 and the bushing 32 as well as the support of the handle 5 on an outer side of the wall 33 can be such, that respective gaps are formed between these elements in a spark-over-proof manner.

The respective handle 5 is detachably mounted on the upper shaft end 23 by means of a spring ring 24, see FIG. 4. For this, the shaft comprises a corresponding ring holding fixture below its shaft end 23 with which the spring ring 24 engages.

The handle 5 in the form of a rotary knob also comprises a corresponding slot in which the spring ring 24 is arranged.

The actuating device 1 can be held in the corresponding slots of the handle 5 and the shaft 6 at the housing 3 only by means of this engagement of the spring ring 24. However, other manners of fastening the actuating device are also usable.

Figure 5:
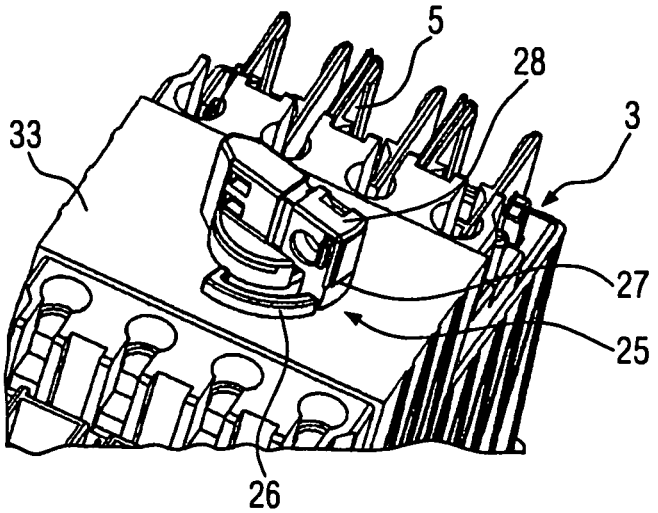
FIG. 5 shows an inclined top view onto the housing with the handle.
Figure 6:
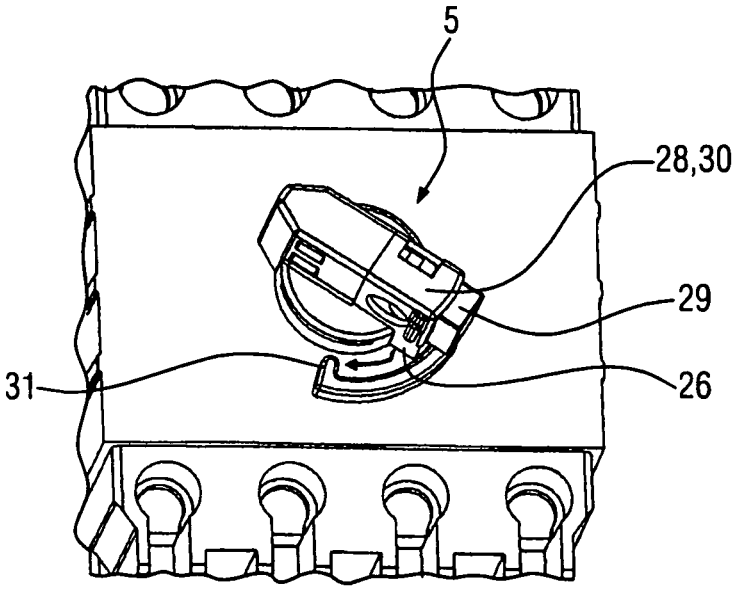
FIG. 6 shows a top view of handle with the locking device.

FIGS. 5 and 6 in particular shows a locking device 25 for the actuating device 1. Regarding the other features of the actuating device 1, reference is made to the previous FIGS. 1 to 4.

The locking device 25 according to FIGS. 5 and 6 comprises a stop element 26 on the upper side of the corresponding housing wall 33 and a stop counter element 27 on the handle 5. In the illustrated embodiment, the stop counter element 27 is formed as a sliding element 28 slideably supported on an end 29 of the handle 5. On its underside facing the housing wall 33, it comprises a projection which can be brought in abutment with one end of the stop element 26, see FIG. 5. If the sliding member 28 is moved on the handle 5 by an operator, see FIG. 6, then the corresponding stop counter element 27 is no longer in abutment with the stop element 26 so that the handle 5 is rotatable according to FIG. 6 in clockwise direction.

The stop element 26 has a partial circular shape and protrudes upwardly from the housing wall 33. In addition to the corresponding end for abutment with the stop counter element 27, it comprises an end stop 31 at the opposite end. It determines how far the handle 5 is rotatable in the clockwise direction after release of the locking device 25.

When the handle 5 is rotated back into the position shown in FIG. 5, then, for example, there is the option that the sliding member 28 be drawn off relative to the handle 5 by the operator to the position according to FIG. 5. In this position, the stop element 26 and the stop counter element 27 are in abutment. It is also possible, that this position according to FIG. 5 is assumed automatically when the handle 5 is rotated to the position according to FIG. 5. This can for example be achieved in that the sliding member 28 is acted upon by force at the handle 5 by means of an elastic element 30 to the corresponding locking position according to FIG. 5. In this case, an operator must displace the sliding member 28 radially inwardly, see the position of the sliding element 28 according to FIG. 6, where he needs to apply a corresponding force against the acting force of the elastic element 30. This elastic element 30 is disposed between the handle 5 and the sliding member 28.

An actuating device 1 is proposed according to the invention which is designed in a simple manner and quickly usable and is adaptable to different on/off levers 4 of different electrical or electronic devices 2 inside a housing 2, see lever insert 13. In addition, the actuating device 1 is supported in a simple manner, for example, only by means of a spring ring 24 of the housing wall 33. The transformation gear 8 causes a respective transformation of rotational motion of the handle 5 into linear motion of the sliding member 12, which by its motion and by means of the lever insert 13 moves the on/off lever 4 for instance between its on and off position. In addition, the handle 5 is by means of a locking device 25 prior to use of the actuating device in a locking position, which must first be released by an operator.

The invention claimed is:

1. An actuating device for an electric device within a flameproof housing, said electric device comprising an essentially linearly movable on/off lever, wherein said actuating device comprises on an outside of said housing at least a rotatably supported handle and a shaft rotationally connected to it, said shaft being led into an interior of said housing and is there by means of a transformation gear for transforming rotational motion into linear motion movably connected to said on/off lever, wherein said transformation gear comprises at least a gear wheel being rotationally connected with said shaft and a gear rod portion being in engagement with its gearing and connected movably to said on/off lever, wherein said gear rod portion is arranged on a sliding member which is connected movably to said on/off lever, wherein said sliding member comprises an exchangeable lever insert for engagement with said on/off lever, and wherein said sliding member comprises a gear wheel holding fixture on an upper side facing said gear wheel.

2. The actuating device according to claim 1, wherein said gear wheel comprises at least a partial gearing.

3. The actuating device according to claim 1, wherein said exchangeable lever insert comprises a lever slot for at least partially receiving said on/off lever.

4. The actuating device according to claim 1, wherein said gear wheel holding fixture comprises two oppositely arranged essentially inverted L-shaped holding flanges, between which said gear wheel is disposed.

5. The actuating device according to claim 4, wherein said gear rod portion is supported by a holding flange in a detachable manner.

6. The actuating device according to claim 1, wherein the upper side of said sliding member comprises a flat sliding surface.

7. The actuating device according to claim 1, wherein said exchangeable lever insert is insertable into said sliding member essentially transversely to a sliding direction into an insert holding fixture that is open in a direction towards said on/off lever.

8. The actuating device according to claim 7, wherein an essentially rail-shaped sliding guide devices are formed at said exchangeable lever insert and at said insert holding fixture.

9. The actuating device according to claim 1, wherein said handle is detachably mounted on a shaft end projecting outwardly from said housing.

10. The actuating device according to claim 1, wherein said actuating device is detachably mounted in said housing.

11. The actuating device according to claim 10, wherein a spring ring for detachable mounting is disposed between said handle and a shaft end.

12. The actuating device according to claim 1, wherein said handle comprises a locking device being releasable for initiating a rotational motion of said handle.

13. The actuating device according to claim 12, wherein said locking device comprises a stop element at said housing and an adjustable stop counter element on said handle.

14. The actuating device according to claim 13, wherein said stop counter element is formed as a sliding member displaceable along said handle.

15. The actuating device according to claim 14, wherein said sliding member is displaceably supported on one end of said handle.

16. The actuating device according to claim 14, wherein said sliding member is acted upon by force in the direction towards said stop element by an elastic element.

* * * * *